US011518420B2

(12) United States Patent
Carl et al.

(10) Patent No.: US 11,518,420 B2
(45) Date of Patent: Dec. 6, 2022

(54) RUNNING GEAR FOR A RAIL VEHICLE AND ASSOCIATED RAIL VEHICLE

(71) Applicant: Bombardier Transportation GmbH, Berlin (DE)

(72) Inventors: Federic Carl, Kassel (DE); Thimo Schönemann, Iserlohn (DE); Andreas Wolf, Winterthur (CH); Wolfgang Auer, Kassel (DE)

(73) Assignee: Bombardier Transportation GmbH, Berlin (DE)

( * ) Notice: Subject to any disclaimer, the term of this patent is extended or adjusted under 35 U.S.C. 154(b) by 400 days.

(21) Appl. No.: 16/611,336

(22) PCT Filed: May 11, 2018

(86) PCT No.: PCT/EP2018/062221
§ 371 (c)(1),
(2) Date: Nov. 6, 2019

(87) PCT Pub. No.: WO2018/206771
PCT Pub. Date: Nov. 15, 2018

(65) Prior Publication Data

US 2020/0070854 A1 Mar. 5, 2020

(30) Foreign Application Priority Data

May 11, 2017 (GB) ..... 1707571

(51) Int. Cl.
*B61F 5/30* (2006.01)
*B61F 5/32* (2006.01)

(52) U.S. Cl.
CPC ..... *B61F 5/30* (2013.01); *B61F 5/301* (2013.01); *B61F 5/305* (2013.01); *B61F 5/32* (2013.01)

(58) Field of Classification Search
CPC ..... B61F 1/14; B61F 5/00; B61F 5/02; B61F 5/04; B61F 5/06; B61F 5/08; B61F 5/12;
(Continued)

(56) References Cited

U.S. PATENT DOCUMENTS 1,758,350 A * 5/1930 Bush ..... B61F 5/06 105/186
4,674,413 A 6/1987 Eggert, Jr.
(Continued)

FOREIGN PATENT DOCUMENTS

DE 19546007 A1 6/1997
EP 0050727 A2 * 5/1982 ..... B61H 7/06
(Continued)

*Primary Examiner* — Zachary L Kuhfuss
*Assistant Examiner* — Cheng Lin
(74) *Attorney, Agent, or Firm* — The Webb Law Firm

(57) ABSTRACT

A running gear for a rail vehicle includes one or more wheel sets, each having a revolution axis and each being guided by a pair of transversally spaced axle boxes. The running gear further includes a running gear frame, a primary suspension assembly between each of the axle boxes and the running gear frame, and a secondary suspension stage for supporting a vehicle superstructure on the running gear frame. Each primary suspension assembly has at least a main spring assembly having a vertical stiffness and a horizontal stiffness that is identical in a transverse direction of the running gear frame and in a longitudinal direction of the running gear frame perpendicular to the transverse direction. The primary suspension assembly further has an anisotropic interface assembly in series with the main spring assembly between the running gear frame and the axle box. The anisotropic interface assembly is such that the primary suspension assembly has a transverse stiffness and a longitudinal stiffness wherein the transverse stiffness is substantially different from the longitudinal stiffness.

11 Claims, 6 Drawing Sheets

(58) Field of Classification Search
CPC ..... B61F 5/14; B61F 5/16; B61F 5/20; B61F 5/22; B61F 5/24; B61F 5/245; B61F 5/32; B61F 5/34; B61F 5/122; B61F 5/301; B61F 5/305
See application file for complete search history.

(56) References Cited

U.S. PATENT DOCUMENTS

| | | | | |
|---|---|---|---|---|
| 5,005,489 | A * | 4/1991 | Terlecky | B61F 5/06 105/158.2 |
| 7,448,329 | B2 | 11/2008 | Muller et al. | |
| 8,047,514 | B2 * | 11/2011 | Wolf | B61F 5/08 267/290 |
| 2019/0344811 | A1 * | 11/2019 | Wolf | B61F 5/305 |

FOREIGN PATENT DOCUMENTS

| | | | | |
|---|---|---|---|---|
| EP | 1569835 | A1 | 9/2005 | |
| EP | 2000383 | A2 | 12/2008 | |
| JP | H0370569 | A | 3/1991 | |
| JP | 2007045275 | A * | 2/2007 | B61H 7/06 |
| JP | 2007045275 | A | 2/2007 | |

* cited by examiner

Fig. 10
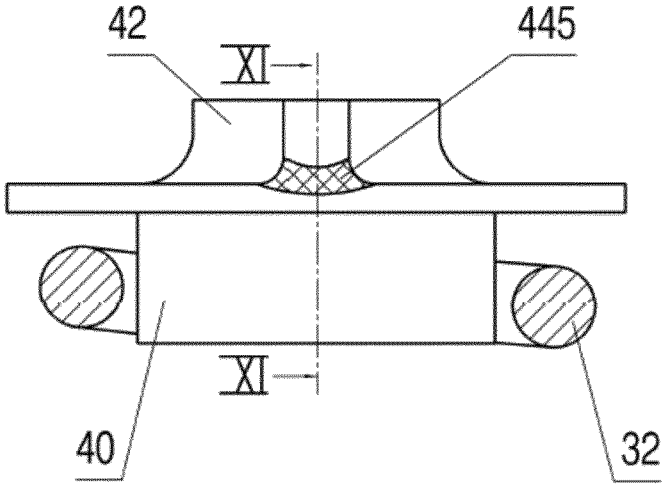
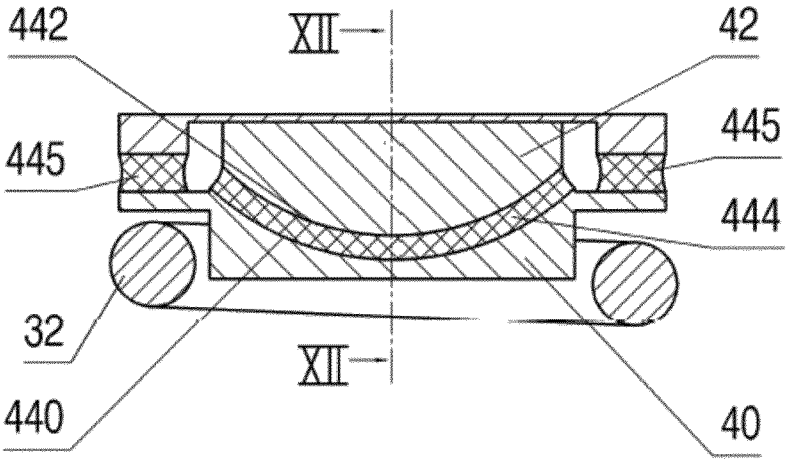
Fig. 11
Fig. 12
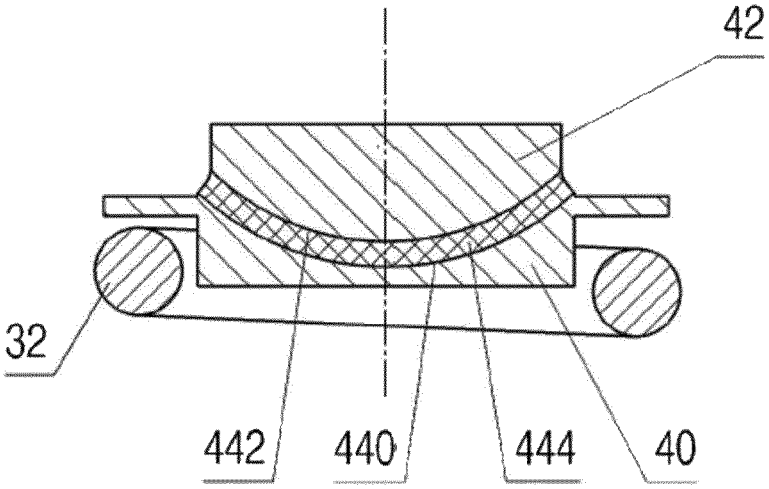

RUNNING GEAR FOR A RAIL VEHICLE AND ASSOCIATED RAIL VEHICLE

CROSS-REFERENCE TO RELATED APPLICATIONS

This application is the United States national phase of International Application No. PCT/EP2018/062221 filed May 11, 2018, and claims priority to United Kingdom Patent Application No. 1707571.4 filed May 11, 2017, the disclosures of which are hereby incorporated by reference in their entirety.

BACKGROUND OF THE INVENTION

Filed of the Invention

The present invention relates to a running gear for a rail vehicle, in particular of a locomotive. It also relates to a vehicle provided with one or more such running gears.

Description of Related Art

Rail vehicles often comprise two suspension stages, namely a primary suspension stage between axle and running gear frame and a secondary suspension stage between the running gear frame and the vehicle body. The primary suspension stage ensures the stability of the vehicle and minimises the burden on the infrastructure, particularly in curves. To fulfil these functions, the primary suspension should have a low stiffness in a longitudinal direction of the vehicle, so that the wheel axle can turn around a vertical axis, and a high stiffness in the transverse direction to ensure a sufficient driving stability.

The primary suspension stage of many rail vehicles, locomotives in particular, includes primary springs such as helical springs, which have the same stiffness in the longitudinal and transverse directions. Thus, the above-mentioned requirement for simultaneous high transverse stiffness and low longitudinal stiffness cannot be met. For safety reasons, the driving stability is granted priority and, therefore, the primary springs are designed so that they have a high horizontal stiffness. This results in a high longitudinal stiffness and increased loads on the tracks.

A primary suspension comprising helical springs having a low horizontal stiffness was proposed in EP1569835. To increase the lateral stiffness of the primary suspension an additional rubber-metal spring is mounted parallel to the helical springs. The rubber-metal spring has a higher stiffness in the transverse direction than in the longitudinal and vertical. In this way, the transverse stiffness is increased while the longitudinal stiffness remains virtually unchanged. However, additional space is necessary for the parallel connection of the rubber-metal springs and helical springs.

Another cumbersome design with multiple parallel springs for generating different longitudinal and transverse stiffness is known from U.S. Pat. No. 4,674,413.

A series connection of two springs is known from EP2000383. Here, a helical spring and a serially connected second rubber-metal spring provide together a two-stage spring characteristic. However, no differentiation of the stiffness in the longitudinal and transverse directions is obtained.

SUMMARY OF THE INVENTION

The invention aims to provide a running gear with a two-stage suspension that has an improved primary stage characteristic, to provide a low longitudinal stiffness and a higher transverse stiffness in a compact layout.

According to a first aspect of the invention, there is provided, a running gear for a rail vehicle, comprising one or more wheel sets, each having a revolution axis, each of the wheel sets being guided by a pair of transversally spaced axle boxes, a running gear frame, a primary suspension assembly between each of the axle boxes and the running gear frame, and a secondary suspension stage for supporting a vehicle superstructure of the rail vehicle on the running gear frame, wherein each primary suspension assembly comprises at least a main spring assembly having a vertical stiffness and a horizontal stiffness that is identical in a transverse direction of the running gear frame and in a longitudinal direction of the running gear frame perpendicular to the transverse direction, characterised in that the primary suspension assembly further comprises an anisotropic interface assembly in series with the main spring assembly between the running gear frame and the axle box, wherein the anisotropic interface assembly is such that the primary suspension assembly has a transverse stiffness and a longitudinal stiffness, wherein the transverse stiffness is substantially different from the longitudinal stiffness.

The series connection of two spring assemblies with different characteristics enables to define the resulting longitudinal stiffness and transverse stiffness independently from one another.

According to a preferred embodiment, the anisotropic interface assembly comprises an intermediate spring seat for receiving an end of the main spring assembly, which can be an upper end if the anisotropic interface assembly is located between the main spring assembly and the running gear frame, or a lower end if the anisotropic interface assembly is located between the main spring assembly and the axle box.

According to a preferred embodiment, the anisotropic interface assembly comprises a guiding structure and guiding means for limiting or suppressing at least two degrees of freedom of motion of the intermediate spring seat relative to the guiding structure, comprising at least one degree of freedom of translation in a longitudinal or transversal direction and at least one degree of freedom of rotation about a longitudinal or transversal axis. Preferably, the guiding means are such as to limit or suppress at least one degree of freedom of translation in the transversal direction and at least one degree of freedom of rotation about an axis parallel to the longitudinal axis. Advantageously, the anisotropic interface comprises at least one resilient element between the guiding structure and the intermediate spring seat.

According to one embodiment, the guiding means are such that the intermediate spring seat has only one degree of freedom of rotation relative to the guiding structure, about a transverse axis of rotation.

According to one embodiment, the guiding means are such that the intermediate spring seat has only one degree of freedom of translation relative to the guiding structure, parallel to a longitudinal direction or the running gear.

The installation space, in particular the height, is a constraint for accommodating the first and second spring assemblies. According to a preferred embodiment, the main spring assembly consists of one or more helical springs. Preferably, the anisotropic interface assembly is at least partially received in an inner volume axially and radially confined within the one or more helical springs of the main spring assembly.

According to one embodiment the anisotropic interface assembly has a torsional stiffness about a pitch axis parallel to the transverse direction. Preferably, the torsional stiffness is substantially constant or increases when the angular deflection increases relative to a nominal position increases.

The longitudinal stiffness has a shear stiffness component and a bending stiffness component about a transverse axis. According to one embodiment, the pitch axis is located above an upper end of the main spring assembly or below a lower end of the main spring assembly. Preferably the longitudinal stiffness of the primary suspension assembly is such that the one or more wheel sets is able to pivot about a vertical axis of the running gear.

According to another aspect of the invention, there is provided a rail vehicle, in particular a locomotive, provided with at least one running gear as described hereinbefore.

BRIEF DESCRIPTION OF THE FIGURES

Other advantages and features of the invention will become more clearly apparent from the following description of a specific embodiment of the invention given as non-restrictive examples only and represented in the accompanying drawings in which:

FIG. 10 is a side view of a primary suspension according to a fifth embodiment of the invention;

FIG. 11 is a cross-section of the primary suspension of FIG. 10, in the plane XI-XI of FIG. 10;

FIG. 12 is a cross-section of the primary suspension of FIG. 10, in the plane XII-XII of FIG. 11;

Corresponding reference numerals refer to the same or corresponding parts in each of the figures.

DETAILED DESCRIPTION OF PREFERRED EMBODIMENTS

Figure 1:
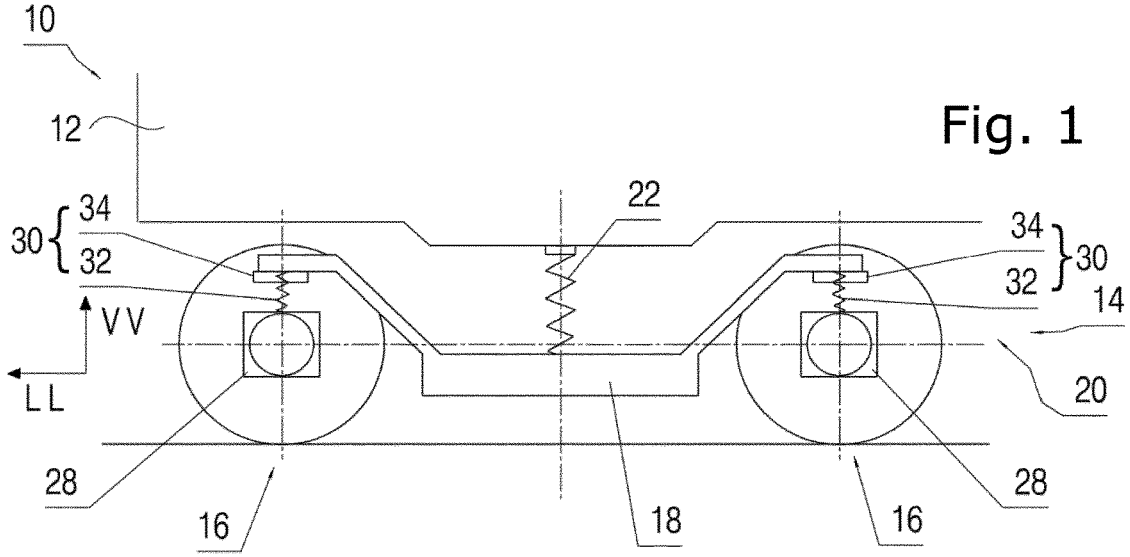
FIG. 1 is a diagrammatic side view of a running gear according to one embodiment of the invention.
Figure 2:
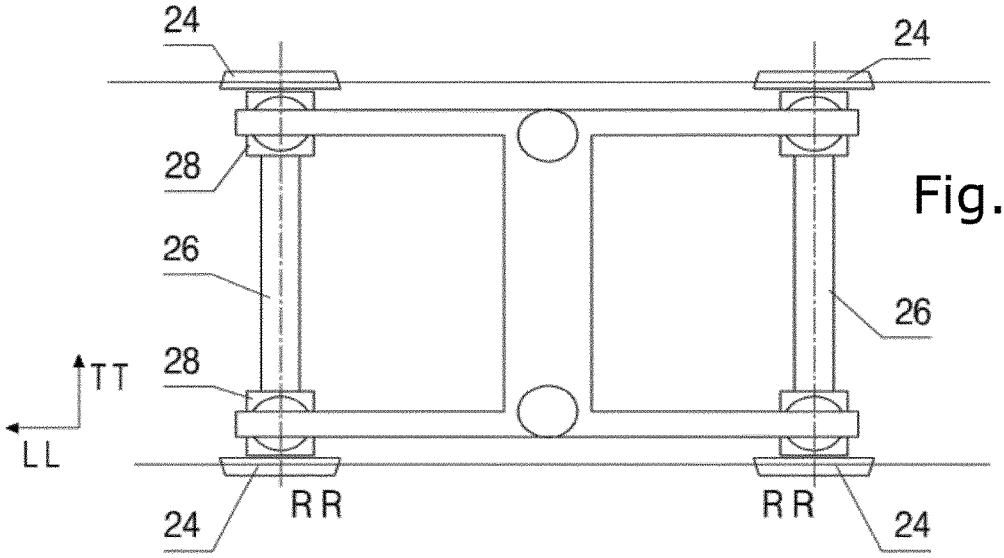
FIG. 2 is a diagrammatic top view of the running gear of FIG. 1

FIGS. 1 and 2 are diagrammatic illustrations of a part of a rail vehicle 10 comprising a vehicle superstructure 12 such as a vehicle body or a vehicle frame supported on a running gear 14. The running gear 14 is designed as a bogie provided with at least two wheel sets 16, a running gear frame 18, a primary suspension stage 20 between the wheel sets 16 and the running gear frame 18 and a secondary suspension stage 22 between the running gear frame 18 and the vehicle superstructure 12. The secondary suspension stage 22 may comprise vertical springs such as helical springs, leaf springs, or air springs for vertically supporting the vehicle superstructure 12 on the running gear frame 18, as well as shock absorbers. It may also include lateral or longitudinal springs or shock absorbers. The running gear frame 18 defines a longitudinal reference axis LL and a transverse reference axis TT perpendicular to a vertical reference axis VV.

Each wheels set 16 comprises a pair of left and right wheels 24 attached to an axle 26 guided by a pair of laterally opposite axle boxes 28 so as to revolve about a revolution axis RR. In a standard rest position of the rail vehicle on a straight horizontal track, the revolution axes RR of the wheel sets 16 are horizontal and parallel to one another and to the transverse reference axis TT of the running gear frame 18.

The primary suspension stage 20 comprises a primary suspension assembly 30 between each axle box 28 and the running gear frame 18. Each primary suspension assembly 30 comprises a main spring assembly 32 and an anisotropic interface assembly 34 in series with the main spring assembly 36, which can be located between the main spring assembly 36 and the axle box 28 or between the main spring assembly 36 and the running gear frame 18.

Figure 3:
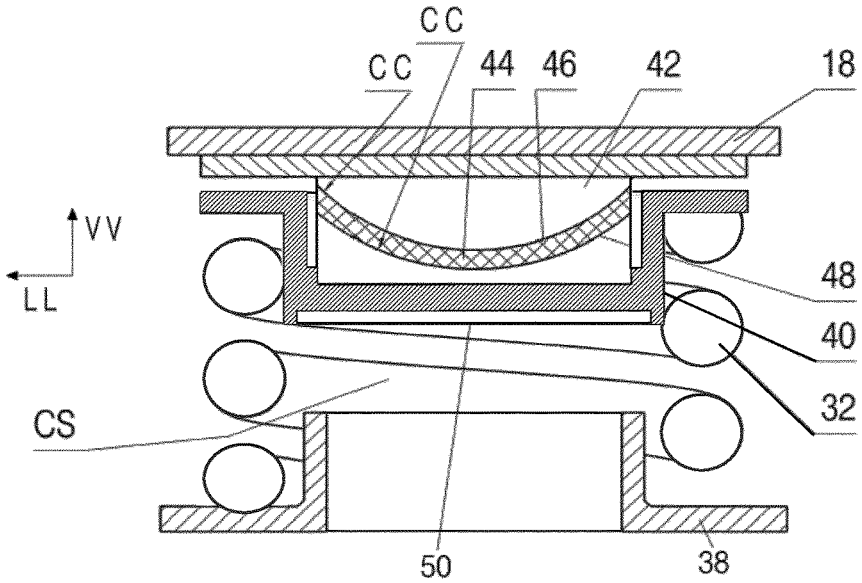
FIG. 3 illustrates a first embodiment of a primary suspension of the running gear of FIG. 1.

According to a first embodiment of the primary suspension assembly illustrated in FIG. 3, the main spring assembly 32 consists of a helical spring, which extends between and bears against a lower spring seat 38 rigidly attached to or integral with the axle box 28 and an intermediate spring seat 40, which is part of the anisotropic interface assembly 34. The main spring assembly 32 has a vertical stiffness $K_{1v}$ and a horizontal stiffness $K_{1h}$, which is identical in the transverse and longitudinal directions of the running gear frame.

The anisotropic interface assembly 34 consists of the intermediate spring seat 40, of a guiding structure 42 that is rigidly attached to or integral with the running gear frame 18 and of an intermediate elastomeric structure 44 which extends between the intermediate spring seat 40 and the guiding structure 42. The guiding structure 42 comprises an upper rigid convex cylindrical surface 46 which faces a lower rigid concave cylindrical surface 48 formed on the intermediate spring seat 40. The intermediate elastomeric structure 44 forms a cylindrical layer between the concave and convex cylindrical surfaces 46, 48.

The cylinder axis CC is located above the main spring assembly 32. Remarkably, the intermediate spring seat 40 is cup-shaped and has a central part 50 that extends within the inner cylindrical space CS surrounded by the helical spring. As a result, the anisotropic interface assembly 34 partly overlaps with the main spring assembly 32 in the vertical direction and the overall height of the primary suspension assembly 30 is not substantially increased by the presence of the anisotropic interface assembly 34.

This arrangement allows the intermediate spring seat 40 to pivot with respect to the guiding structure 42 about the cylinder axis CC with a low stiffness. This movement is referred to as tilting and results in a limited freedom of movement of each axle box 28 in the longitudinal direction LL. On the other hand, due to the cylindrical shape of the elastomeric layer 44, the turning stiffness about an axis perpendicular to the cylinder axis CC, is substantially higher than in the longitudinal direction LL.

The anisotropic interface assembly 34 substantially reduces the longitudinal stiffness of each primary suspension assembly 30, and does not substantially impact the stiffness in the vertical and transverse directions.

The freedom of movement of each axle box 28 with respect to the running gear frame 18 in the longitudinal direction LL of the running gear frame allows each wheel axle 26 to pivot about an imaginary vertical axis so as to minimise the load on the track.

Due to the compact layout of the anisotropic interface assembly 34 within the main spring assembly 32, this embodiment is particularly suitable for retrofitting pre-existing vehicles.

Figure 4:
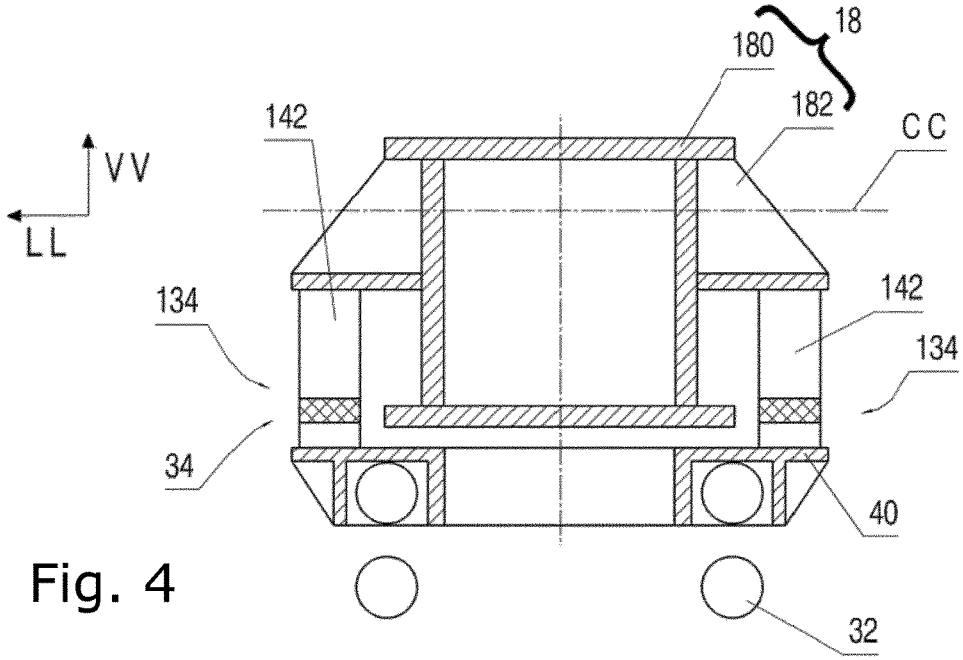
FIG. 4 is a cross-section of a primary suspension according to a second embodiment of the invention.
Figure 5:
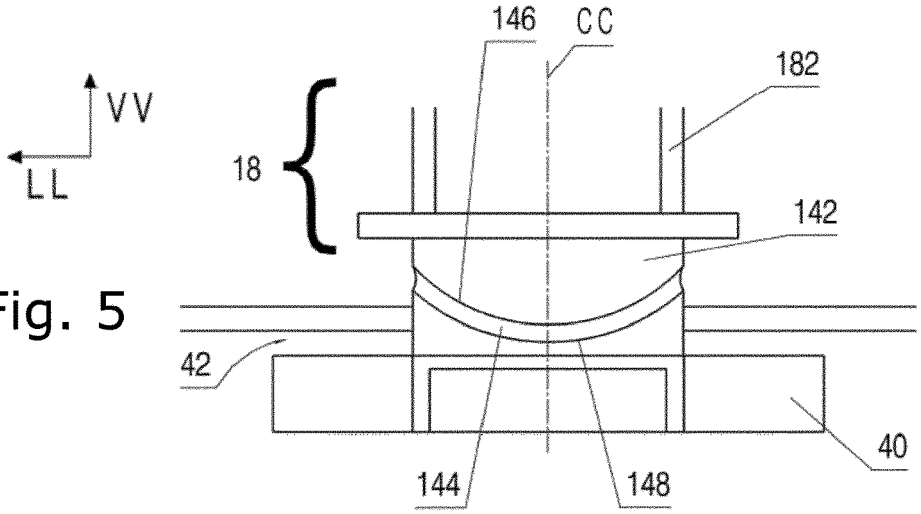
FIG. 5 is a side view from the primary suspension of FIG. 4.

FIGS. 4 and 5 illustrate a second embodiment of a primary suspension assembly for use with the running gear of FIGS. 1 and 2. This embodiment differs from the embodiment of FIG. 3 mainly in that the anisotropic interface assembly 34 comprises two structures 134 that are spaced apart from one another in the transverse direction, so that a longitudinal beam 180 of the running gear frame 18 can be accommodated between the two structures. The two separate structures 134 extend vertically between a support bracket 182 of the running gear 18 and the intermediate spring seat 40. Accordingly, the guiding structure comprises two guiding elements 142, each of which has a rigid convex cylindrical surface 146. The intermediate spring seat 40 has two rigid concave cylindrical surfaces 148, each of which faces one of the two rigid convex cylindrical surfaces 146 of the guiding structure 42. Each structure 134 further comprises an elastomeric layer 144 between the associated rigid convex cylindrical surface 146 and rigid concave cylindrical surface 148.

The behaviour of the anisotropic interface assembly 34 and of the whole primary suspension assembly is essentially the same as for the embodiment of FIG. 3.

Figure 6:
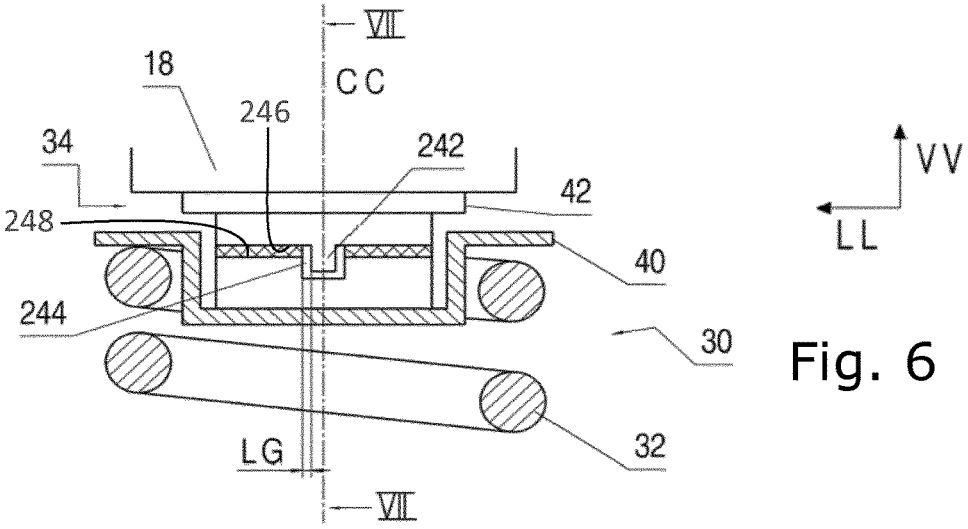
FIG. 6 is a cross-section of a primary suspension according to a third embodiment of the invention in the plane VI-VI of FIG. 7.
Figure 7:
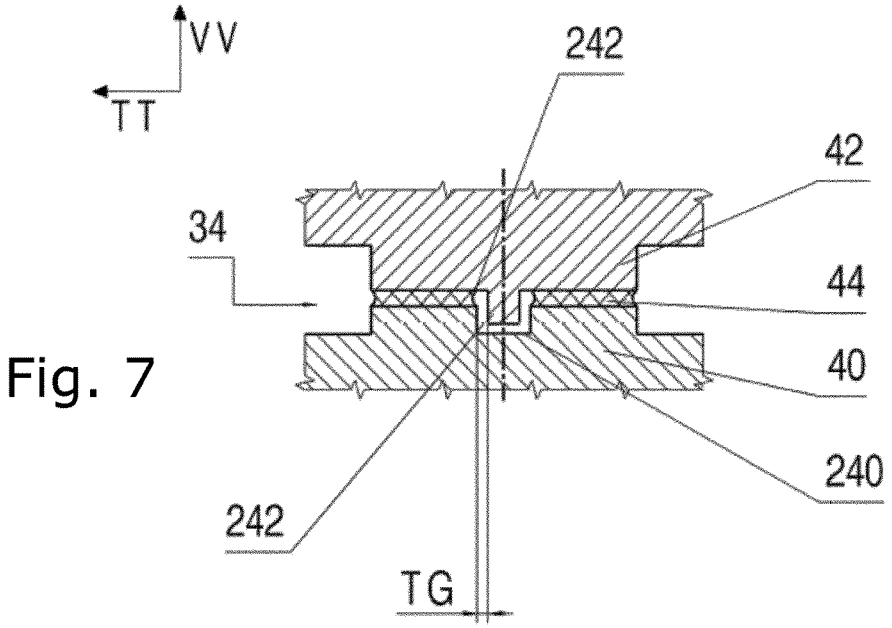
FIG. 7 is another cross-section of the primary suspension of FIG. 6, in the plane VII-VII of FIG. 6.

The embodiment of FIGS. 6 and 7 differs from the embodiment of FIG. 3 in that the guiding structure 42 comprises an upper rigid planar surface 246 which faces a parallel planar surface 248 formed on the intermediate spring seat 40. The intermediate elastomeric structure 44 forms a planar layer of constant thickness between the planar surfaces 46, 48. The guiding structure 42 is provided with a protrusion 242 that engages a recess 240 provided in the intermediate spring seat 40 through a through hole 244 provided in the elastomeric layer 44. A predefined limited gap TG is formed between the protrusion 242 and the walls of the recess 240 in the transverse direction TT. A larger gap LG is formed between the protrusion 242 and the walls of the recess 240 in the longitudinal direction LL. When the primary suspension is subjected to a transverse load above a predetermined threshold, the protrusion 242 of the guiding structure 42 bears against the walls to limit the deflection in the transverse direction. Above this threshold, the stiffness of the primary suspension assembly 30 in the transverse direction TT is solely determined by the main spring assembly 32. In the longitudinal direction LL on the other hand, the play LG between the protrusion 242 and the walls of the recess 240 is large enough to allow the anisotropic interface assembly 34 to respond to the whole range of dynamic longitudinal loads without interference between the protrusion 242 and the walls of the recess 240.

As a variant, the protrusion can be formed on the intermediate spring seat 40 and the recess in the guiding structure 42.

Figure 8:
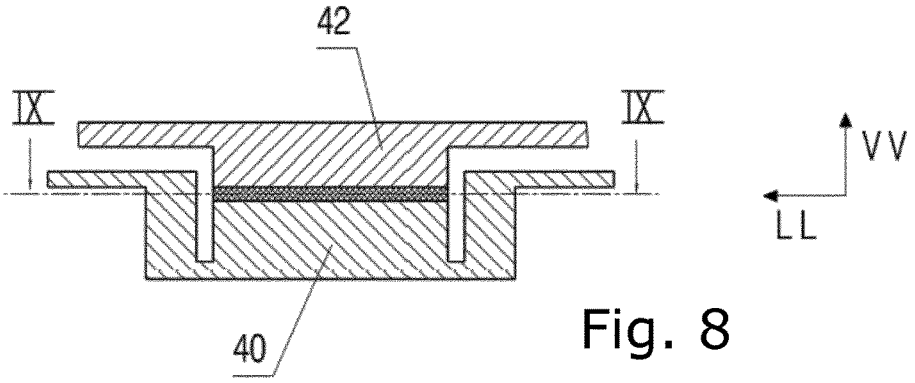
FIG. 8 is a cross-section of a primary suspension according to a fourth embodiment of the invention.
Figure 9:
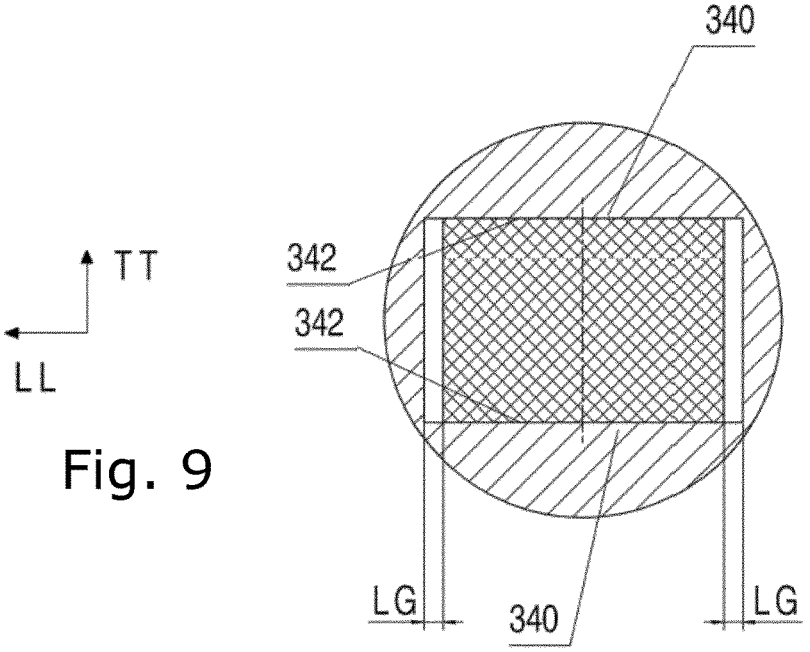
FIG. 9 is a section of the primary suspension of FIG. 8 in the plane IX-IX of FIG. 8.

The embodiment of FIGS. 8 and 9 differs from the embodiment of FIG. 3 in that the intermediate spring seat 40 is provided with planar walls 340, which are perpendicular to the transverse direction and are in sliding contact with corresponding planar walls 342 of the guiding structure 42, to prevent any movement of the intermediate spring seat 40 relative to the guiding structure 42 in the transverse direction TT. The transverse stiffness of the anisotropic interface assembly is extremely high and the overall transverse stiffness of the primary suspension assembly is equal to the transverse stiffness of the main spring assembly.

The embodiment of FIGS. 10 to 12 differs from the embodiment of FIG. 3 in that the anisotropic interface assembly 34 comprises several elastomeric elements in parallel, namely an elastomeric layer 444 between a concave spherical cap 440 formed on the intermediate spring seat 40 and a convex spherical cap 442 formed on the guiding structure 42 and two elastomeric pads 445 located transversally on both sides of spherical cap structure. As will be readily understood, the spherical cap structure has a torque stiffness, which is substantially identical in all directions, while the two elastomeric pads 455 limit the freedom of rotation about a longitudinal horizontal axis. The elastomeric pads 455 are preferably curved and have preferably the same pitch axis as the elastomeric layer 444. According to a variant of this embodiment, the caps 440 and 442 can be cylindrical with a cylinder axis parallel to the transverse axis.

Figure 13:
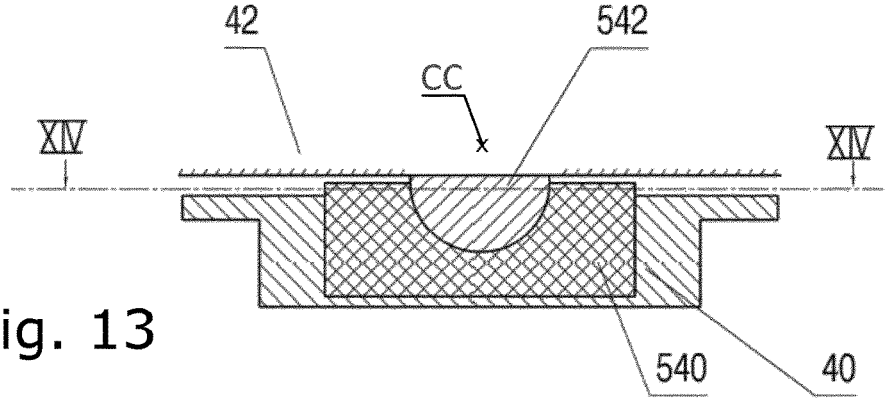
FIG. 13 is a cross-section of a primary suspension according to a sixth embodiment of the invention.
Figure 14:
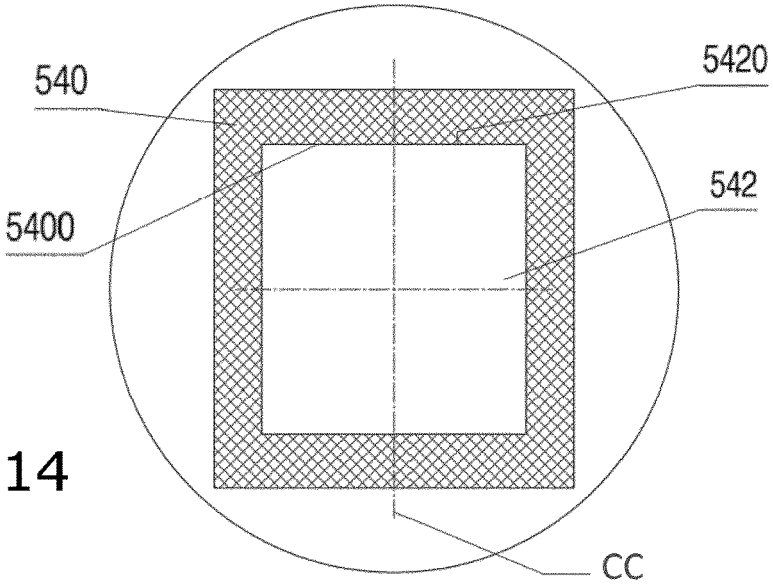
FIG. 14 is a section of the primary suspension of FIG. 13 in the plane XIV-XIV of FIG. 13.

The embodiment of FIGS. 13 and 14 differs from the embodiment of FIG. 3 in that the anisotropic interface assembly 34 consists of a pivot assembly between the running gear frame and the upper end of the helical spring 32 of the main spring assembly, to allow the upper end of the helical spring 32 to pivot about a pitch axis CC parallel to the transverse reference axis TT of the running gear frame 18. More specifically, the guiding structure 42 consists of a male hemi-cylindrical part 542 fixed to the running gear frame 18 and while the intermediate spring seat 40 is provided with a female hemi-cylindrical part 540. The two hemi-cylindrical parts are made of metal and preferably coated to reduce friction. The male part 542 has two planar end walls 5420 that bear against two planar end walls 5400 of the female part.

As a result, the anisotropic interface assembly 34 provides one degree of freedom of rotation to the upper end of the main helical springs 32 about the pitch axis CC. When subjected to load in the longitudinal direction LL, the upper end of the helical spring 32 does not remain parallel to its lower end and the helical spring 32 is allowed to bend slightly. In the transverse direction TT on the other hand, the anisotropic interface assembly 34 does not provide any degree of freedom, and the two ends of the helical spring 32 remain parallel to one another. As a result, the stiffness in the longitudinal direction LL is substantially lower than in the lateral direction TT.

Figure 15:
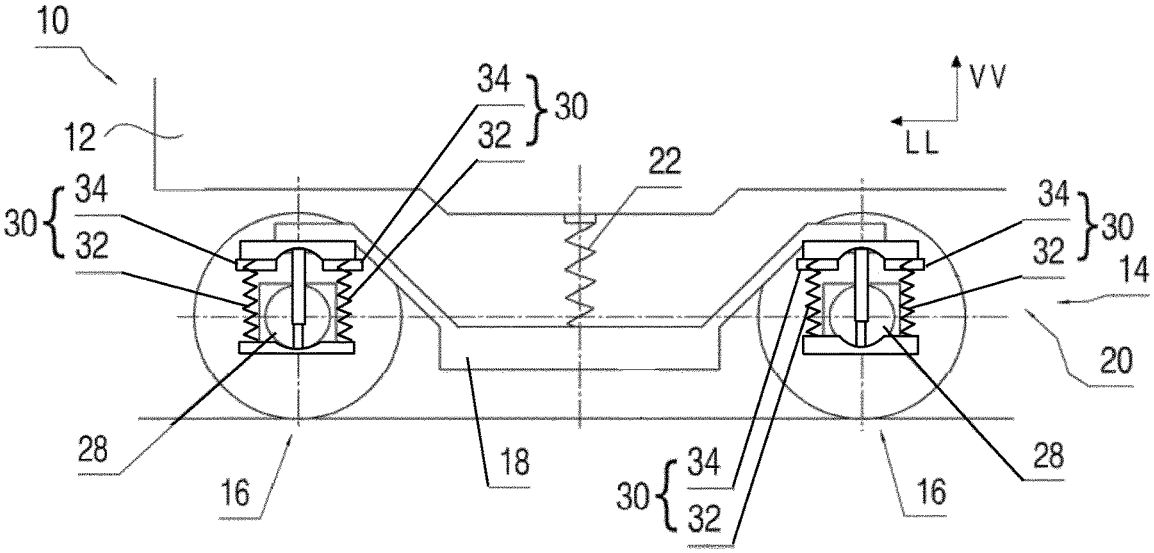
FIG. 15 is a diagrammatic illustration of a running gear according to a seventh embodiment of the invention.
Figure 16:
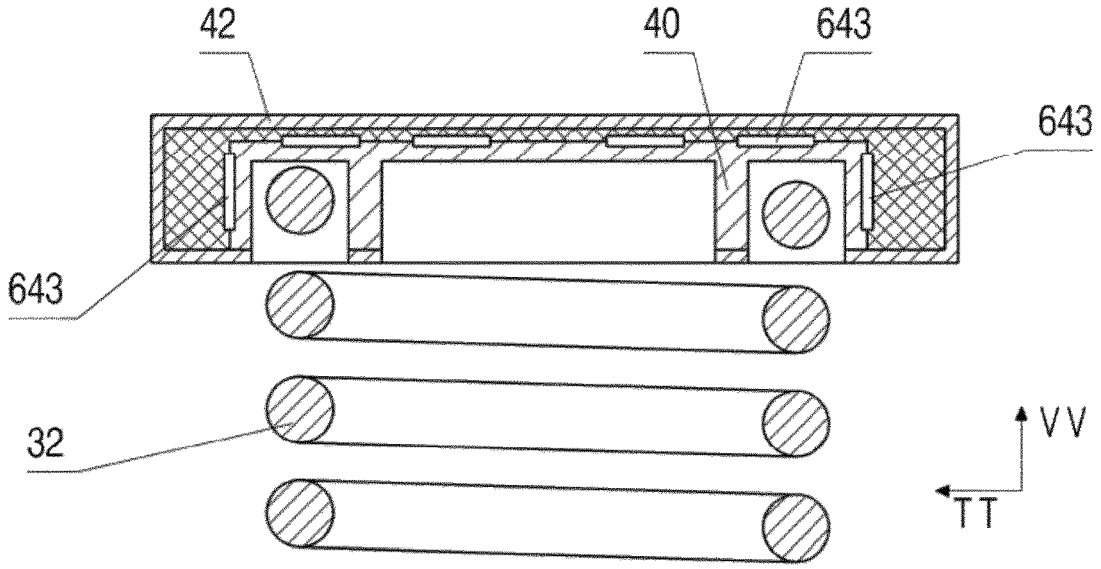
FIG. 16 is a cross-section of a primary suspension of the running gear of FIG. 15.
Figure 17:
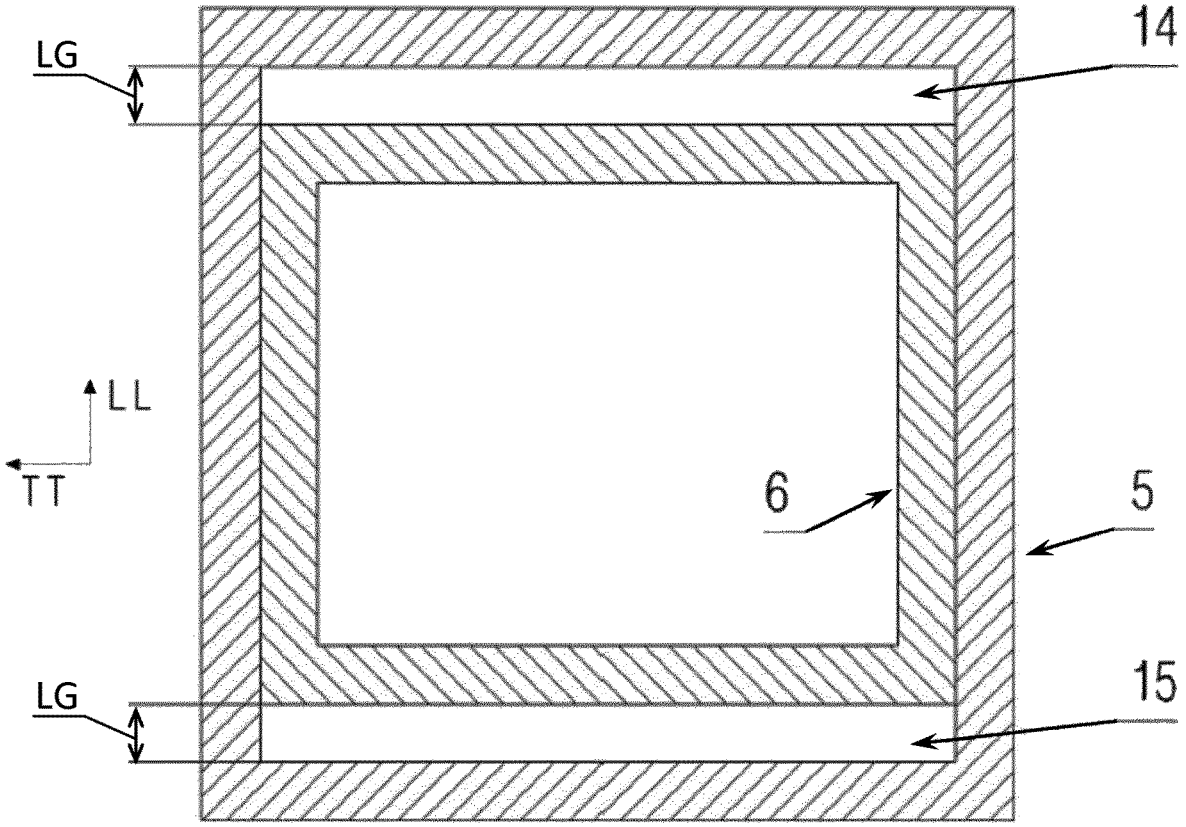
FIG. 17 is a section of the primary suspension of FIG. 15 in the plane XVII-XVII of FIG. 16.

The running gear of FIG. 15 differs from the running gear of FIG. 1 in that the primary suspension assembly 30 between each axle box and the running gear frame 18 comprises two parallel primary suspension structures 630, each consisting of a main spring assembly 32 in series with an anisotropic interface assembly 34 illustrated in FIGS. 16 and 17. More specifically, the main spring assembly 32 consists of a helical spring, and the anisotropic interface assembly 34 is placed on top of the helical spring 32, between the latter and the running gear frame 18. The anisotropic interface assembly 34 comprises a guiding structure 42 fixed relative to the running gear frame 18, a movable intermediate spring seat 40 received within the guiding structure 42 and rolling bodies 643, e.g. rollers, that roll on raceways formed on the intermediate spring seat 40 and on the guiding structure 42 to form a linear roller bearing. More specifically, the raceways are formed on two opposite horizontal walls of the guiding structure 42 and of the intermediate spring seat 40 and on two pairs of opposite vertical walls of the guiding structure 42 and of the intermediate spring seat 40, which are parallel to the longitudinal direction LL. A clearance LG is provided between the guiding structure 42 and the intermediate spring seat 40 in the longitudinal direction LL. As result, the intermediate spring seat 40 has only one degree of freedom of translation with respect to the guiding structure 42, namely in the longitudinal direction LL of the running gear. Resilient elements can be added between the guiding structure 42 and the intermediate spring seat 40 to provide some stiffness in the longitudinal direction. In any case, the equivalent stiffness of the primary suspension assembly 30 in the transverse direction TT is equal to the horizontal stiffness of the main spring 32, while the equivalent stiffness in the longitudinal direction LL is substantially lower.

The invention claimed is:

1. A running gear for a rail vehicle, comprising:

one or more wheel sets, each having a revolution axis and being guided by a pair of transversally spaced axle boxes;

a running gear frame;

a primary suspension assembly between each of the axle boxes and the running gear frame; and a secondary suspension stage for supporting a vehicle superstructure of the rail vehicle on the running gear frame, wherein each primary suspension assembly comprises at least a main spring assembly having a vertical stiffness and a horizontal stiffness that is identical in a transverse direction of the running gear frame and in a longitudinal direction of the running gear frame perpendicular to the transverse direction, wherein the primary suspension assembly further comprises an anisotropic interface assembly in series with the main spring assembly between the running gear frame and the axle box, wherein the anisotropic interface assembly is such that the primary suspension assembly has a transverse stiffness and a longitudinal stiffness, wherein the transverse stiffness is different from the longitudinal stiffness, wherein the anisotropic interface assembly comprises an intermediate spring seat for receiving an end of the main spring assembly, wherein the anisotropic interface assembly comprises a guiding structure and a guiding means for limiting or suppressing at least two degrees of freedom of motion of the intermediate spring seat relative to the guiding structure, comprising at least one degree of freedom of translation in a longitudinal or transversal direction and at least one degree of freedom of rotation about a longitudinal or transversal axis, wherein the anisotropic interface assembly has a torsional stiffness about a pitch axis parallel to the transverse direction, and wherein the pitch axis is located above an upper end of the main spring assembly or below a lower end of the main spring assembly.

2. The running gear of claim 1, wherein the guiding means are such as to limit or suppress at least one degree of freedom of translation in the transversal direction and at least one degree of freedom of rotation about an axis parallel to the longitudinal axis.

3. The running gear of claim 1, wherein the anisotropic interface comprises at least one resilient element between the guiding structure and the intermediate spring seat.

4. The running gear of claim 1, wherein the guiding means are such that the intermediate spring seat has only one degree of freedom of rotation relative to the guiding structure about a transverse axis of rotation.

5. The running gear of claim 1, wherein the guiding means are such that the intermediate spring seat has only one degree of freedom of translation relative to the guiding structure parallel to a longitudinal direction of the running gear.

6. The running gear of claim 1, wherein the main spring assembly consists of one or more helical springs.

7. The running gear of claim 6, wherein the anisotropic interface assembly is at least partially received in an inner volume axially and radially confined within the one or more helical springs of the main spring assembly.

8. The running gear of claim 1, wherein the longitudinal stiffness of the primary suspension assembly is such that the one or more wheel sets is able to pivot about a vertical axis of the running gear.

9. A rail vehicle provided with at least one running gear according to claim 1.

10. A running gear for a rail vehicle, comprising:

one or more wheel sets, each having a revolution axis and being guided by a pair of transversally spaced axle boxes;

a running gear frame;

a primary suspension assembly between each of the axle boxes and the running gear frame; and a secondary suspension stage for supporting a vehicle superstructure of the rail vehicle on the running gear frame, wherein each primary suspension assembly comprises at least a main spring assembly having a vertical stiffness and a horizontal stiffness that is identical in a transverse direction of the running gear frame and in a longitudinal direction of the running gear frame perpendicular to the transverse direction, wherein the primary suspension assembly further comprises an anisotropic interface assembly in series with the main spring assembly between the running gear frame and the axle box, wherein the anisotropic interface assembly is such that the primary suspension assembly has a transverse stiffness and a longitudinal stiffness, wherein the transverse stiffness is different from the longitudinal stiffness, wherein the anisotropic interface assembly comprises an intermediate spring seat for receiving an end of the main spring assembly, wherein the anisotropic interface assembly comprises a guiding structure and a guiding means for limiting or suppressing at least two degrees of freedom of motion of the intermediate spring seat relative to the guiding structure, comprising at least one degree of freedom of translation in a longitudinal or transversal direction and at least one degree of freedom of rotation about a longitudinal or transversal axis, and wherein the guiding means are such that the intermediate spring seat has only one degree of freedom of rotation relative to the guiding structure about a transverse axis of rotation.

11. A running gear for a rail vehicle, comprising:

one or more wheel sets, each having a revolution axis and being guided by a pair of transversally spaced axle boxes;

a running gear frame;

a primary suspension assembly between each of the axle boxes and the running gear frame; and a secondary suspension stage for supporting a vehicle superstructure of the rail vehicle on the running gear frame, wherein each primary suspension assembly comprises at least a main spring assembly having a vertical stiffness and a horizontal stiffness that is identical in a transverse direction of the running gear frame and in a longitudinal direction of the running gear frame perpendicular to the transverse direction, wherein the primary suspension assembly further comprises an anisotropic interface assembly in series with the main spring assembly between the running gear frame and the axle box, wherein the anisotropic interface assembly is such that the primary suspension assembly has a transverse stiffness and a longitudinal stiffness, wherein the transverse stiffness is different from the longitudinal stiffness, wherein the anisotropic interface assembly comprises an intermediate spring seat for receiving an end of the main spring assembly, wherein the anisotropic interface assembly comprises a guiding structure and a guiding means for limiting or suppressing at least two degrees of freedom of motion of the intermediate spring seat relative to the guiding structure, comprising at least one degree of freedom of translation in a longitudinal or transversal direction and at least one degree of freedom of rotation about a longitudinal or transversal axis, and wherein the guiding means are such that the intermediate spring seat has only one degree of freedom of translation relative to the guiding structure parallel to a longitudinal direction of the running gear.

* * * * *